US007556702B2

(12) United States Patent
Koch

(10) Patent No.: US 7,556,702 B2
(45) Date of Patent: Jul. 7, 2009

(54) PYROTECHNIC CHARGE

(75) Inventor: Ernst-Christian Koch, Kaiserslautern (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 687 days.

(21) Appl. No.: 11/126,618

(22) Filed: May 11, 2005

(65) Prior Publication Data

US 2006/0011277 A1 Jan. 19, 2006

(30) Foreign Application Priority Data

May 19, 2004 (DE) ..... 10 2004 024 857

(51) Int. Cl.
*C06B 31/28* (2006.01)
*D03D 23/00* (2006.01)
*D03D 43/00* (2006.01)

(52) U.S. Cl. ..... 149/46; 149/109.4; 149/109.6

(58) Field of Classification Search ..... 149/46, 149/109.4, 109.6
See application file for complete search history.

(56) References Cited

U.S. PATENT DOCUMENTS 5,834,680 A * 11/1998 Nielson et al. ..... 102/336
6,427,599 B1 * 8/2002 Posson et al. ..... 102/336
6,578,492 B1 6/2003 Koch et al.
6,581,520 B1 6/2003 Koch et al.
6,635,130 B2 10/2003 Koch
2003/0150535 A1 8/2003 Koch
2005/0067070 A1 3/2005 Koch

FOREIGN PATENT DOCUMENTS

EP GB 2 299 990 A 4/1995
EP GB 2 354 060 A 1/1999
GB 2 314 558 A 4/1996

OTHER PUBLICATIONS http://en.wikipedia.org/wiki/Deuterium.*

* cited by examiner

*Primary Examiner*—Michael A Marcheschi
*Assistant Examiner*—James E McDonough
(74) *Attorney, Agent, or Firm*—Scully, Scott, Murphy & Presser, P.C.

(57) ABSTRACT

A pyrotechnic charge for producing IR radiation is proposed, in which a deuterated compound is contained as fuel and/or as oxidizing agent or as fuel, as oxidizing agent and/or as binder. The use of such a pyrotechnic charge leads to a greater selective radiant emission in the β-band and at the same time to a reduced selective radiant emission in the α-band, so that the signature of a decoy is adapted to that of an aircraft.

19 Claims, 1 Drawing Sheet

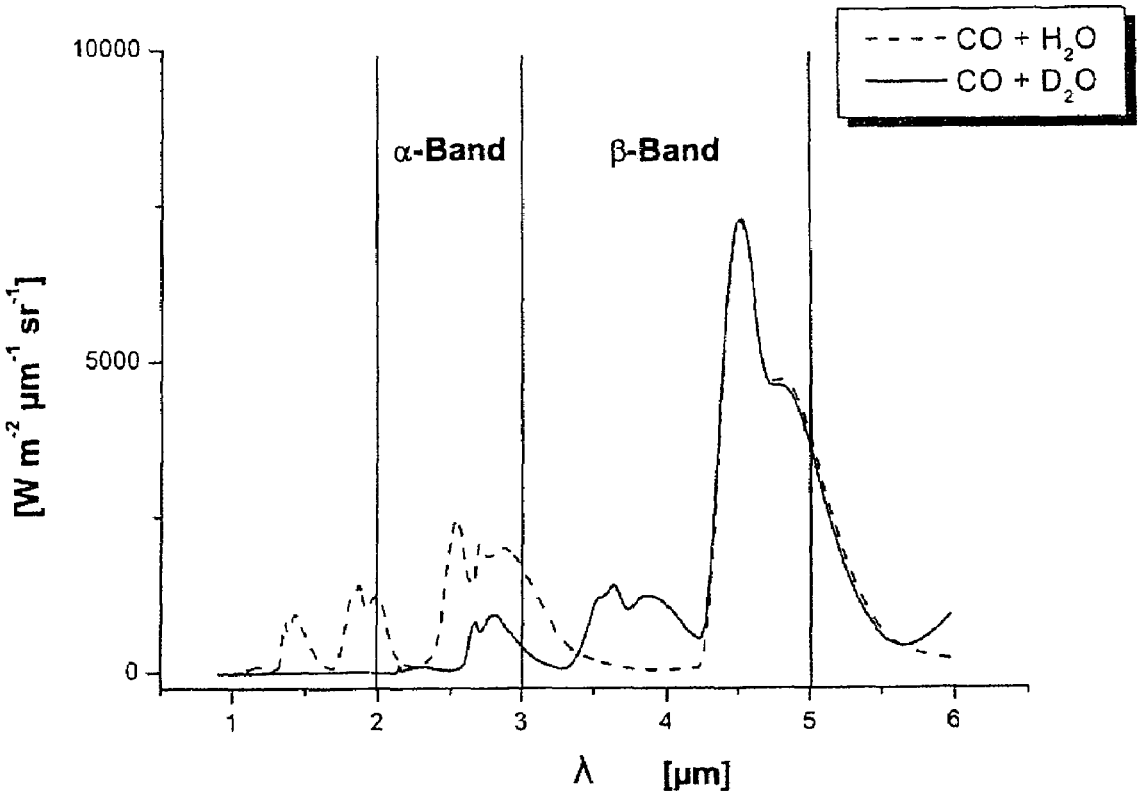
CO + H2O
CO + D2O
α-Band
β-Band
10000
5000
0
[W m-2 µm-1 sr-1]
1
2
3
4
5
6
λ [µm]

PYROTECHNIC CHARGE

BACKGROUND OF THE INVENTION

1. Field of the Invention

The present invention relates to a pyrotechnic charge, in particular a pyrotechnic charge for producing IR radiation, which can advantageously be used in an infrared decoy.

In the military sector, missiles, such as air-to-air and ground-to-air guided missiles, which head for and pursue the infrared (IR) radiation emitted by the engine of the target, chiefly in the range between 0.8 and 5 μm, with the aid of a search head sensitive to IR radiation, are used for combatting air targets, such as, for example, jet aircraft, helicopters and transport machines. For defence against these missiles, decoys (also referred to as flares) which imitate the IR signature of the target in order to deflect approaching guided missiles are therefore used. Such decoys can also be used preventively in order to complicate or even prevent the detection of targets by reducing the contrast of the scene.

A typical active composition for producing black body radiation in the IR range is a pyrotechnic charge comprising magnesium, polytetrafluoroethylene (Teflon®) and vinylidene fluoride/hexafluoroisoprene copolymer (Viton®), also referred to as MTV, which exhibits a black body-like spectral intensity distribution on combustion. However, the actual signature of, for example, aircraft engines differs from the signature of a black body emitter since the hot exhaust gases of the turboprop or jet engines emit strong selective components in the wavelength range between 3 and 5 μm (so-called β-band). This selective radiant emission is due to the combustion products CO and $CO_2$, which emit at 4.61 μm and 4.17 μm, respectively.

2. Discussion of the Prior Art

In order to distinguish between decoys having a black body signature and genuine flying targets, modern homing heads therefore additionally carry out a spectral evaluation of the radiation. Particular attention is paid to the fact that the integrated intensity of the signature of an aircraft or its engine in the wavelength range between 3 and 5 μm (β-band) is a factor of 2 greater than the integrated intensity in the wavelength range between 2 and 3 μm (so-called α-band). In the case of decoys having a black body signature, this ratio is, on the other hand, always less than 1.

In order to overcome the spectral differentiation of decoys by homing heads on this basis, adapted decoys which have an aircraft-like spectral intensity distribution were proposed in the past.

For example, decoys which contain pyrotechnic charges based on carbon-rich compounds and oxygen carriers are being proposed for this purpose. In addition, those active charges which contain boron as a fuel were also proposed. The combustion of carbon-rich compounds results in the formation of, in particular, CO and $CO_2$, which serve for the selective radiation emission in the β-band from 3 to 5 μm; the combustion of boron results in particular in the formation of HBO and HOBO, which likewise selectively emit in the β-band at 3.51 and at 4.94 μm and 2.72 μm, respectively.

In the design of the first-mentioned, carbon-rich active charges, it is necessary to achieve in the case of the combustion products a $CO_2/H_2O$ ratio which is always substantially less than 1. This is associated with the selective radiant emission of water in the wavelength range at 2.73 μm. The excessive formation of water should therefore be avoided as far as possible with regard to the quotient of the integrated intensities in the α-band and β-band, explained above. For this reason, the prior art proposed, for example, hydrogen-poor aromatic carboxylic anhydrides (cf. U.S. Pat. No. 6,427,599) and hydrogen-rich cyano compounds as fuels in pyrotechnic active compositions for spectrally adapted decoys. However, the hydrogen contained in the carbon-containing compositions always also leads to strong radiant emissions in the α-band, due to substances such as HO (2.67 μm), HCl (3.34 μm) and $H_2O$ (2.73 μm).

With the use of boron as fuel, the hydrogen present from, for example, the ammonium perchlorate, likewise always leads to an impairment of the spectral ratio since HOBO formed in the flame also emits at 2.72 μm and therefore contributes to an increase in the integrated intensity in the range from 2 to 3 μm (α-band).

In the case of said conventional active compositions, the radiant emission in these wavelength ranges therefore reduces the efficiency of the respective decoys on the one hand due to false components in the short-wave α-band, which in the worst case lead to rejection of the decoy, and, on the other hand, due to an only slightly specific radiant emission in the β-band in the acquisition range of the decoy.

SUMMARY OF THE INVENTION

It is therefore the object of the invention to provide a pyrotechnic charge for producing IR radiation, which charge produces an aircraft-like spectral intensity distribution on combustion of the fuels. In particular, the quotient of the integrated radiation intensities of the β-band and of the α-band on combustion of the fuels of the pyrotechnic charge should be better adapted to that of the signature of an aircraft.

This object is achieved by a pyrotechnic charge for producing IR radiation, characterized in that a deuterated compound is contained therein as a fuel and/or as an oxidizing agent.

The pyrotechnic charge for producing IR radiation according to a first aspect of the invention contains a deuterated compound as fuel and/or as oxidizing agent. According to a second aspect of the invention, the pyrotechnic charge for producing IR radiation contains a deuterated compound as fuel, as oxidizing agent and/or as binder.

The use of deuterated compounds, i.e. compounds enriched with deuterium, as fuel, oxidizing agent and/or binder leads to a greater selective radiant emission in the β-band and at the same time to a reduced selective radiant emission in the α-band, so that the quotient of the integrated radiation intensities of the β-band and of the α-band on combustion of the fuels of the pyrotechnic charge of the invention is better adapted to that of the signature of an aircraft. In the deuterated compound, preferably at least 50% by weight of the hydrogen atoms are deuterium atoms.

For example, deuterated hydrocarbons, such as, for example, anthracene-$d^{10}$ and phenanthrene-$d^{10}$, deuterated boranes, such as, for example, nido-decaborane-$d^{14}$ ($B_{10}D_{14}$), deuterated polysilanes of the general composition $(SiD_x)_n$ where $0<x\leqq 2$, alkali metal borodeuterides of the general composition $M(BD_4)$ where M=Li, Na, K, Rb or Cs, and alkali metal aluminium deuterides of the general composition $M(AlD_4)$ where M=Li, Na, K, Rb or Cs are used as fuel in the pyrotechnic charge.

Here, the fuel is preferably contained in an amount by mass of about 10% to about 55%, particularly preferably in an amount by mass of about 10% to about 35%.

For example, deuterated ammonium compounds, such as, for example, ammonium perchlorate-$d^4$ ($ND_4ClO_4$, CAS No. [55304-22-8]), ammonium nitrate-$d^4$ ($ND_4NO_3$, [15117-65-4]), ammonium dinitramide-$d^4$ ($ND_4N(NO_2)_2$) and hydrazinium nitroformate-$d^5$ ($N_2D_5C(NO_2)_3$), are used as oxidizing agents in the pyrotechnic charge.

Here, the oxidizing agent is preferably contained in an amount by mass of about 40% to about 85%, particularly preferably in an amount by mass of about 55% to about 85%.

For example, a deuterated polymer, such as, for example, hexafluoroisoprene-vinylidene dichloride-$d^2$ copolymer ($(—C_5D_2F_8—)_n$, deuterated HTPB, polyethlene-$d^4$ ($(—CD_2CD_2—)_n$, PVC-$d^3$ ($(—CD_2CDCl—)_n$ and polystyrene-$d^8$ ($(—CD(C_6D_5)—CD_2—)_n$, is used as the binder in the pyrotechnic charge.

Here, the binder is preferably contained in an amount by mass of about 1.5% to about 5%.

BRIEF DESCRIPTION OF THE DRAWING

The single FIGURE represents a plot of selective radiant emissions for deuterated compounds.

DETAILED DESCRIPTION OF THE INVENTION

The invention explained above starts from the consideration as described below.

According to the invention, it is intended to provide a pyrotechnic charge which, on combustion of hydrocarbons and boron together with oxidizing agents, such as, for example, ammonium perchlorate, in decoy active compositions, concentrates more selective radiant emission components in the desired β-band, i.e. in the wavelength range from 4 to 5 μm, in order better to imitate the signature of an aircraft engine.

An X-H stretching vibration can be described in a first approximation as a harmonic oscillator. The vibration frequency vis then determined by $$v = \frac{1}{2\pi c} \cdot \sqrt{\frac{k}{\mu}},$$

with k: force constant of the bond between the atoms i and j, and

μ: reduced mass given by the relationship $$\frac{1}{\mu} = \frac{1}{m_i} + \frac{1}{m_j},$$

with $m_i$ and $m_j$: mass of the atoms or molecular fragments.

If the hydrogen in the above-defined compounds of conventional active compositions is now substituted by an atom of higher mass, the wavelength number ν decreases, i.e. the wavelength λ increases.

Three isotopes of hydrogen are known namely $^1$H-hydrogen, $^2$H-hydrogen, also referred to as deuterium ($^2$D), and the radioactive $^3$H-hydrogen, also referred to as tritium ($^3$T). Owing to the additional neutron in the nucleus, the mass of deuterium is twice as great as that of $^1$H.

With about the same force constant k, replacement of the $^1$H-hydrogen by deuterium in the abovementioned combustion products ($H_2O$, HO, $CH_4$, HCN, HOB, HOBO, HCl) leads to a reduction in the frequency ν and hence to an increase in the wavelength λ, i.e. to a bathochromic shift. As shown in the table below and especially for $H_2O$ in the attached figure, deuterated compounds have a strong selective radiant emission in the spectral range between 3 and 5 μm, i.e. in the α-band particularly relevant here, and in particular between 3.5 and 4.8 μm. As is evident from the table in the figure, the molecular emissions of hydrogen-containing species shift by about 1 μm to greater wavelengths when deuterated compounds are to be used, which leads to greater radiant emission in the α-band from 3 to 5 μm, and at the same time the radiant emission in the β-band from 2 to 3 μm is reduced by the same proportion.

TABLE

| H compound | ν in $cm^{-1}$ | λ in μm | D compound | ν in $cm^{-1}$ | λ in μm |
|---|---|---|---|---|---|
| $H_2$ | 4395 | 2.28 | $D_2$ | 3119 | 3.21 |
| | | | HD | 3817 | 2.62 |
| $H_2O$ | 3657 | 2.73 | $D_2O$ | 2671 | 3.74 |
| | | | HDO | 2727 | 3.67 |
| HO | 3735 | 2.67 | DO | 2721 | 3.68 |
| $CH_4$ | 2917 | 3.43 | $CD_4$ | 2085 | 4.80 |
| HCN | 3311 | 3.02 | DCN | 2630 | 3.80 |
| $NH_3$ | 3335 | 3.00 | $ND_3$ | 2419 | 4.14 |
| HCl | 2991 | 3.34 | DCl | 2145 | 4.66 |
| HF | 4139 | 2.41 | DF | 2998 | 3.34 |
| $H^{11}BO$ | 2849 | 3.51 | $D^{11}BO$ | 2316 | 4.31 |
| | | | $D^{10}BO$ | 2369 | 4.22 |
| $HO^{10,11}BO$ | 2023 | 4.94 | $DO^{10,11}BO$ | 2013 | 4.97 |
| | 3681 | 2.72 | | 2713 | 3.69 |

All data from K. Nakamoto, "Infrared and Raman Spectra of Inorganic and Coordination Compounds", Part A, Wiley, New York, 1997.

It is therefore proposed to use deuterated compounds as fuels and/or oxidizing agents, alternatively also as binders, for pyrotechnic IR active compositions with a selective radiant emission in the α-band in the range from 3 to 5 μm.

Suitable fuels in the context of the invention are deuterated or at least partly deuterated (≧50% by weight of D) hydrocarbons, alkali metal borodeuterides of the general formula $M(BD_4)$ with M=Li, Na, K, Rb or Cs, alkali metal aluminium deuterides of the general formula $M(AlD_4)$ with M=Li, Na, K, Rb or Cs, and nido-tetradecadeuterodecaborane ($B_{10}D_{14}$).

Suitable oxidizing agents in the context of the invention are ammonium perchlorate-$d^4$ ($ND_4ClO_4$, CAS No. [55304-22-8], cf. R. J. C. Brown et al., "The thermodynamics of perchlorate. Heat capacity of $ND_4ClO_4$ from 7 to 345 K and the analysis of heat capacities and related data of $NH_4ClO_4$ and $ND_4ClO_4$", J. Chem. Phys. 91, 1989, pages 399-407), ammonium nitrate-$d^4$ ($ND_4NO_3$, [15117-65-4], cf. M. Ahtee et al., "The structure of the low-temperature phase V of Ammonium Nitrate, $ND_4NO_3$", Acta Cryst. 1983, C39, pages 651-655), ammonium dinitramide-$d^4$ ($ND_4N(NO_2)_2$, no CAS No. known), hydrazinium nitroformate-$d^5$ ($N_2D_5C(NO_2)_3$, no CAS No. known) and the like.

Suitable binders in the context of the invention are deuterated polymers, such as hexafluoroisoprene-vinylidene difluoride-$d^2$ copolymer ($(—C_5D_2F_8—)_n$, deuterated HTPB, polyethylene-$d^4$ ($(—CD_2—CD_2—)_n$, PVC-$d^3$ ($(—CD_2CDCl—)_n$, polystyrene-$d^8$ ($(—CD(C_6D_5)—CD_2—)_n$ and the like.

The invention claimed is:

1. A pyrotechnic charge for producing IR radiation comprising at least one deuterated compound, wherein at least 50% by weight of hydrogen atoms present in the at least one deuterated compound are deuterium atoms.

2. The pyrotechnic charge of claim 1 wherein said at least one deuterated compound contained in the charge is a fuel.

3. The pyrotechnic charge of claim 1 wherein said at least one deuterated compound contained in the charge is an oxidizing agent.

4. The pyrotechnic charge of claim 1 wherein said at least one deuterated compound contained in the charge is a binder.

5. The pyrotechnic charge of claim 1 wherein said at least one deuterated compound contained in the charge is a fuel and an oxidizing agent.

6. The pyrotechnic charge of claim 1 wherein said at least one deuterated compound contained in the charge is a fuel, an oxidizing agent and a binder.

7. The pyrotechnic charge of claim 2 wherein the at least one deuterated compound is a compound selected from the group consisting of deuterated hydrocarbons, deuterated boranes, deuterated polysilanes, alkali metal borodeuterides and alkali metal aluminium deuterides.

8. The pyrotechnic charge of claim 2 wherein the at least one deuterated compound is a compound selected from the group consisting of deuterated anthracene and deuterated phenanthrene.

9. The pyrotechnic charge of claim 2 wherein said at least one deuterated compound is nido-decaborane-$d^{14}$.

10. The pyrotechnic charge of claim 2 wherein said at least one deuterated compound is contained in a proportion by mass of about 10% to about 55%.

11. The pyrotechnic charge of claim 10 wherein the at least one deuterated compound is contained in a proportion by mass of about 10% to about 35%.

12. The pyrotechnic charge of claim 3 wherein said at least one deuterated compound is a deuterated ammonium compound.

13. The pyrotechnic charge of claim 12 wherein the deuterated ammonium compound is selected from the group consisting of deuterated ammonium perchlorate, deuterated ammonium nitrate, deuterated ammonium dinitramide and deuterated hydrazinium nitroformate.

14. The pyrotechnic charge of claim 3 wherein said at least one deuterated compound is contained in a proportion by mass of about 40% to about 85%.

15. The pyrotechnic charge of claim 14 wherein said at least one deuterated compound is contained in a proportion by mass of about 55% to about 85%.

16. The pyrotechnic charge of claim 4 wherein said deuterated compound is a deuterated polymer.

17. The pyrotechnic charge of claim 16 wherein said deuterated polymer is selected from the group consisting of hexafluoroisoprene-vinylidene difluoride-$d^2$ copolymer, deuterated HTPB, deuterated polyethylene, deuterated PVC and deuterated polystyrene.

18. The pyrotechnic charge of claim 4 wherein said at least one deuterated compound is contained in a proportion by mass of about 1.5% to about 5%.

19. A pyrotechnic charge for producing IR radiation comprising at least one deuterated compound, wherein said at least one deuterated compound contained in the charge is a fuel comprising nido-decaborane-$d^{14}$.

* * * * *